US008289357B2

(12) United States Patent
Suga

(10) Patent No.: US 8,289,357 B2
(45) Date of Patent: Oct. 16, 2012

(54) LIGHT BEAM NUMBER CHANGEABLE OPTICAL WRITING APPARATUS

(75) Inventor: Tomoaki Suga, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 262 days.

(21) Appl. No.: 12/720,784

(22) Filed: Mar. 10, 2010

(65) Prior Publication Data

US 2010/0231684 A1 Sep. 16, 2010

(30) Foreign Application Priority Data

Mar. 13, 2009 (JP) ..... 2009-061108

(51) Int. Cl.
*B41J 2/44* (2006.01)

(52) U.S. Cl. ..... 347/237; 347/247

(58) Field of Classification Search ..... 347/233, 347/237, 243, 247
See application file for complete search history.

(56) References Cited

U.S. PATENT DOCUMENTS 6,779,725 B2 8/2004 Kohchi et al.
7,515,322 B2 4/2009 Suga
7,612,928 B2 * 11/2009 Tomita ..... 359/204.1
7,626,744 B2 * 12/2009 Arai et al. ..... 359/204.1
2010/0060711 A1 * 3/2010 Shibuya et al. ..... 347/233

FOREIGN PATENT DOCUMENTS

JP 2004-77714 A 3/2004
JP 2006-301182 A 11/2006
JP 2007-168299 A 7/2007
JP 2007-293202 A 11/2007
JP 2008-209675 A 9/2008

* cited by examiner

*Primary Examiner* — Huan Tran
(74) *Attorney, Agent, or Firm* — Dickstein Shapiro LLP

(57) ABSTRACT

An optical writing apparatus includes a light source device that includes a VCSEL having an alignment of at least two channels in a sub scanning direction configured to emit plural light beams in a block. A deflector deflects the plural light beams toward an image bearer that forms an image by changing a line speed of image formation. A control device decreases a number of light beams by turning off a prescribed same number of the channels symmetrically from the both ends of the alignment in accordance with the line speed.

9 Claims, 9 Drawing Sheets

NUMBER OF CHANNELS: ODD, LINE SPEED: CHANGED TO ABOUT 0.95 TIMES Vmax, CONTROL OF LIGHTENING CENTRAL CHANNEL

FIG. 10

| | | | PATTERN a | PATTERN b | PATTERN c | PATTERN d | PATTERN e |
|---|---|---|---|---|---|---|---|
| SPEED RATIO | N | | 1.0 | 0.9 | 0.8 | 0.7 | 0.6 |
| PROCESS LINE SPEED | V | [mm/s] = N × Vmax | 352.80 | 317.52 | 282.24 | 246.96 | 211.68 |
| PIXEL DENSITY | | [dpi] | 2400 | 2400 | 2400 | 2400 | 2400 |
| DOT CENTER INTERVAL | D | [μm] = DPI/25.4mm | 10.6 | 10.6 | 10.6 | 10.6 | 10.6 |
| NECESSARY EXPOSURE ENERGY | Q | [mJ/m^2] | 3.55 | 3.55 | 3.55 | 3.55 | 3.55 |
| BEAM LIGHTENING TERM RATE | E | | 0.6442 | 0.6442 | 0.6442 | 0.6442 | 0.6442 |
| WRITING WIDTH | L | [mm] | 320 | 320 | 320 | 320 | 320 |
| LIGHT USAGE EFFICIENCY | α | | 0.022 | 0.022 | 0.022 | 0.022 | 0.022 |
| BEAM NUMBER | | [NUMBER OF PIECES] = N × M | 40 | 36 | 32 | 28 | 24 |
| LIGHT EMISSION OUTPUT FROM LIGHT SOURCE | P | [mW] = (Q・L・V) / (M・E・α) | 0.71 | 0.71 | 0.71 | 0.71 | 0.71 |
| SCANNING INTERVAL | | [μm] = (N × M)・D | 423.3 | 381.0 | 338.7 | 296.3 | 254.0 |
| SCANNING CYCLE | | [μsec] = (N × M)・D/V | 1199.9 | 1199.9 | 1199.9 | 1199.9 | 1199.9 |

LIGHT BEAM NUMBER CHANGEABLE OPTICAL WRITING APPARATUS

CROSS REFERENCE TO THE RELATED APPLICATION

This application claims priority under 35 USC §119 to Japanese Patent Application No. 2009-061108, filed on Mar. 13, 2009, the entire contents of which are herein incorporated by reference.

BACKGROUND OF THE INVENTION

1. Field of the Invention

The present invention relates to a multi beam scanning type optical writing device, and an image forming apparatus, such as a digital copier, a laser printer, etc, including the multi beam scanning type optical writing device.

2. Discussion of the Background Art

An image bearer included in an image forming apparatus needs a prescribed amount of exposure energy Q per unit area to function. Specifically, a light source needs a light emission output power P calculated by the following formula, wherein alpha represents light usage efficiency of an optical scanning system (i.e., a ratio between emitted light and used light amounts in the system), V represents a process line speed (i.e., a running speed of a recording medium), M represents a number of beams emitted from a light source, E represents a light beam turning on time rate, and L represents a writing width in a main scanning direction;

$$P=(Q\cdot L\cdot V)/(M\cdot E\cdot \alpha). \quad \text{(Formula 1)}$$

Accordingly, the light emission output power P needs be increased N times when the process line speed V becomes N times (N<1) of the maximum speed Vmax. However, it is demanded that both of the maximum and minimum light emission output powers of a light source device (e.g. a chip) need be suppressed within a prescribed range.

Since a light emission output power of the light source needs be changed to compensate deterioration of the image bearer and adjust developing density or the like, a central value between the maximum and minimum light emission output powers needs be suppressed as minimum as possible as discussed in the Japanese Patent Application No.2007-293202.

However, when a VCSEL (vertical cavity surface emitting laser) is employed for the light source device, a range between the maximum and the minimum light emission output powers is further narrowed in comparison with a conventional LD (Laser Diode) or a LDA (Laser Diode Array).

To operate in multiple steps of an image formation line speed, the light usage efficiency alpha needs be changed and increases cost.

Further, in an image formation system using a multi beam light emission type VCSEL, reciprocity failure phenomena occurs and causes a banding image at a frequency noticeable to human eyes. Thus, so-called skip scanning described below is needed to employ to suppress the reciprocity failure phenomena.

To appropriately execute the skip scanning without scanning the same line on an image bearer with light beams, intervals between respective neighboring multi beams (i.e., channels) in the sub scanning direction on the image bearer need be partially and symmetrically changed per block of scanning. Thus, a number M of light beams is hardly changed.

The publications of Japanese Patent Application Nos. 2007-293202, 2006-301182, 2004-77714, 2008-209675, and 2007-168299 discuss the related arts.

SUMMARY OF THE INVENTION

Accordingly, an object of the present invention is to address and resolve such and other problems and provide a new and novel optical writing apparatus. Such a new and novel optical writing apparatus includes a light source device including a VCSEL having an alignment of at least two channels in a sub scanning direction configured to emit at least two light beams in a block and a deflector that deflects the at least two light beams toward an image bearer. The image bearer forms an image by changing a line speed of image formation. A control device is provided to decrease a number of light beams by turning off a prescribed same number of the channels symmetrically from the both ends of the alignment in accordance with the line speed.

In another aspect of an optical writing apparatus, the control device decreases the number of beams by turning off the same number of the light beams symmetrically from the center of the alignment.

In yet another aspect, the control device decreases a number of beams by selectively turning off the same number of the light beams symmetrically from either the both ends or the center of the alignment.

In yet another aspect, the light beams are written in a skip scanning manner.

In yet another aspect, the number of channels emitting the light beams is even more than four, and an interval in the sub-scanning direction between central two channels is D, and each of intervals between the other channels is 2D.

In yet another aspect, the number of channels emitting the light beams is even more than four, and an interval in the sub-scanning direction between central two channels is D, and each of intervals between the other channels is 2D/3.

In yet another aspect, the number of channels emitting the light beams is odd more than three, and an interval in the sub-scanning direction between each of channels is the same.

In yet another aspect, a detection device is provided to detect a write start time based on a light beam not turned off when the number of turn on channels is decreased.

In yet another aspect, an image forming apparatus comprises a speed controller configured to change a process line speed. The number of turn on channels is changed in accordance with the process line speed.

In yet another aspect, the process line speed is decreased when a thicker paper or a particular paper is used.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIGS. 4*a* to 4*c* each are views schematically illustrating an exemplary optical write scanning operation executed by the VCSEL having forty channels of beams, of which FIG. 4*a* represents sequential scanning, FIG. 4*b* skip scanning 1, and FIG. 4*c* skip scanning 2;

FIGS. 5*a* and 5*b* each are views schematically illustrating an exemplary optical write scanning operation executed by the VCSEL having odd number of channels, of which FIG. 5*a* represents sequential scanning and FIG. 5*b* represents skip scanning;

FIGS. 6*a* and 6*b* each are views schematically illustrating an exemplary optical write scanning operation executed by the VCSEL having forty channels when a line speed is changed, of which FIG. 6*a* represents sequential scanning, FIG. 6*b* skip scanning 1, and FIG. 6*c* skip scanning 2;

FIGS. 7*a* and 7*b* each are views schematically illustrating an exemplary optical write scanning operation executed by the VCSEL having odd number of channels when a line speed is changed, of which FIG. 7*a* represents sequential scanning and FIG. 7*b* represents skip scanning;

FIGS. 8A to 8C each are views schematically illustrating an exemplary optical write scanning operation when a line speed is changed and light emission control is started from a center of the channels, of which FIG. 8*a* represents sequential scanning, FIG. 8*b* skip scanning 1, and FIG. 8*c* skip scanning 2;

FIG. 10 is a table showing specific values when a laser printer 100 according to the embodiment of the present invention changes the line speed.

PREFERRED EMBODIMENTS OF THE PRESENT INVENTION

Figure 1:
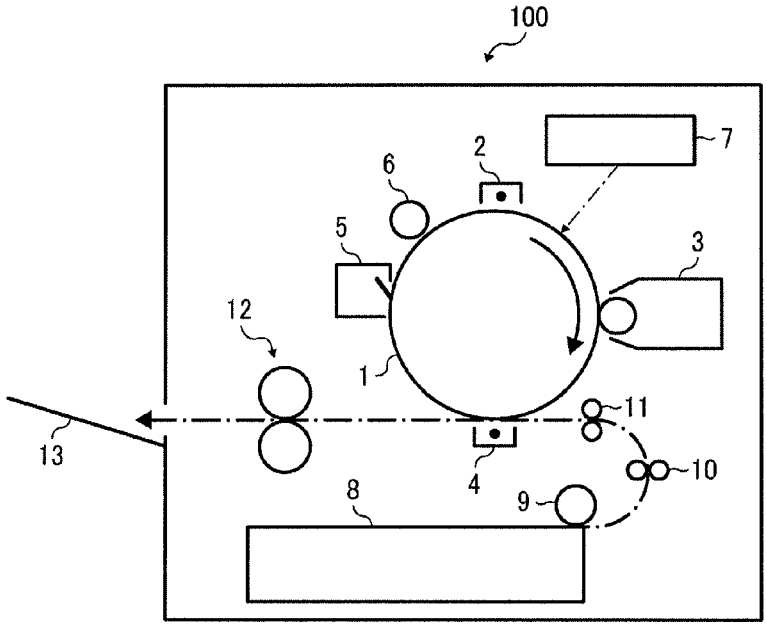
FIG. 1 schematically illustrates an exemplary laser printer as an image forming apparatus according to one embodiment of the present invention.

Referring now to the drawing, wherein like reference numerals designate identical or corresponding parts throughout several views, in particular, in FIG. 1, a laser printer 100 includes a photoconductive drum 1 serving as an image bearer, in which a charge device 2, a developing device 3, a transfer device 4, a cleaning device 5, and a charge removing device 6 or the like are arranged around the photoconductive drum 100. An exposure position exists between the charge device 2 and the developing device 3. Thus, a laser light is emitted from an optical writing device 7 arranged above to the photoconductive drum 1.

At the lower section, there are provided a sheet-feeding cassette 8, a sheet feeding roller 9, a conveyance roller pair 10, and a registration roller pair 11 or the like. Further, beside a transfer section in which the photoconductive drum 1 opposes to the transfer device 4, there is provided a fixing device 12.

Now, an image formation operation of the above-mentioned laser printer 100 is briefly described. When the image formation operation starts, the photoconductive drum 1 is driven rotated by a drive device, not shown, clockwise, and the surface thereof is uniformly charged in a prescribed polarity by the charge device 2. In the optical writing device 7, a LD (laser Diode), not shown, is driven based on image data transmitted from a host machine such as a personal computer and emits a light beam serving as a writing light onto the photoconductive drum 1.

Thus, a latent image is formed on the photoconductive drum 1, and is visualized as a toner image upon receiving toner from the developing device 3.

Further, a printing sheet is launched from the sheet-feeding cassette 8 by the sheet-feeding roller 9, and is conveyed by the conveyance roller pair 10. The printing sheet temporarily collides with and stops at a registration roller 11, and is launched in synchronism with the visualized image. The printing sheet then receives the toner image at a transfer section, in which the photoconductive drum 1 faces the transfer device 4. The toner image is fused into the printing sheet when the printing sheet passes through the fixing device 12 by heat and pressure applied therefrom. The printing sheet is then ejected and stacked on a sheet ejection tray 13 by a sheet ejection roller, not shown.

When the toner has transferred onto the printing sheet, the cleaning device 5 removes attraction substance, such as toner, etc., remaining on the surface of the photoconductive drum 1. The charge removing device 6 then removes electric charge remaining on the surface of the photoconductive drum 1, thereby one cycle of an image formation operation is completed.

Figure 2:
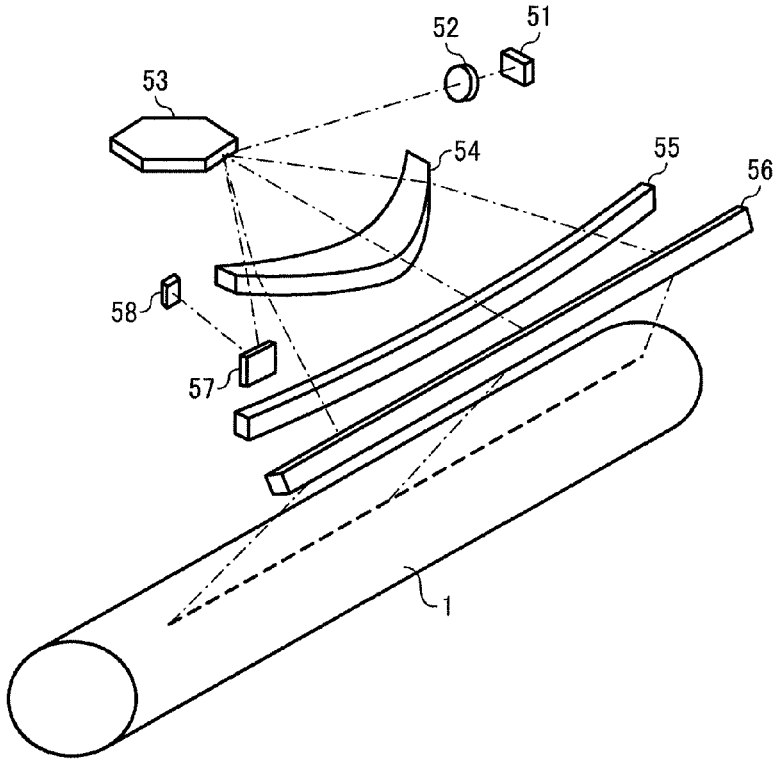
FIG. 2 schematically illustrates a principal part of an exemplary optical writing device according to one embodiment of the present invention.

Now, an exemplary optical writing device 7 is described with reference to FIG. 2. As shown, the optical writing device 7 includes a VCSEL 51 serving as an optical light source device, a collimate lens 52, a polygon mirror 53 serving as a rotation deflector, first and second imaging lenses 54 and 55, and a folding back mirror 56 or the like. The light beams emitted at once from the VCSEL 51 are reflected by the polygon mirror 53, travel the first and second imaging lenses 54 and 55. The light beams are further reflected by the folding back mirror 56, and thereby scanning the photoconductive drum 1.

Further, a synchronism detection sensor 58 is arranged outside an image region to detect the optical light beam emitted from the VCSEL 51 and outputs a signal representing a detection time serving as a reference for starting optical writing. 57 denotes a reflection mirror.

Figure 3:
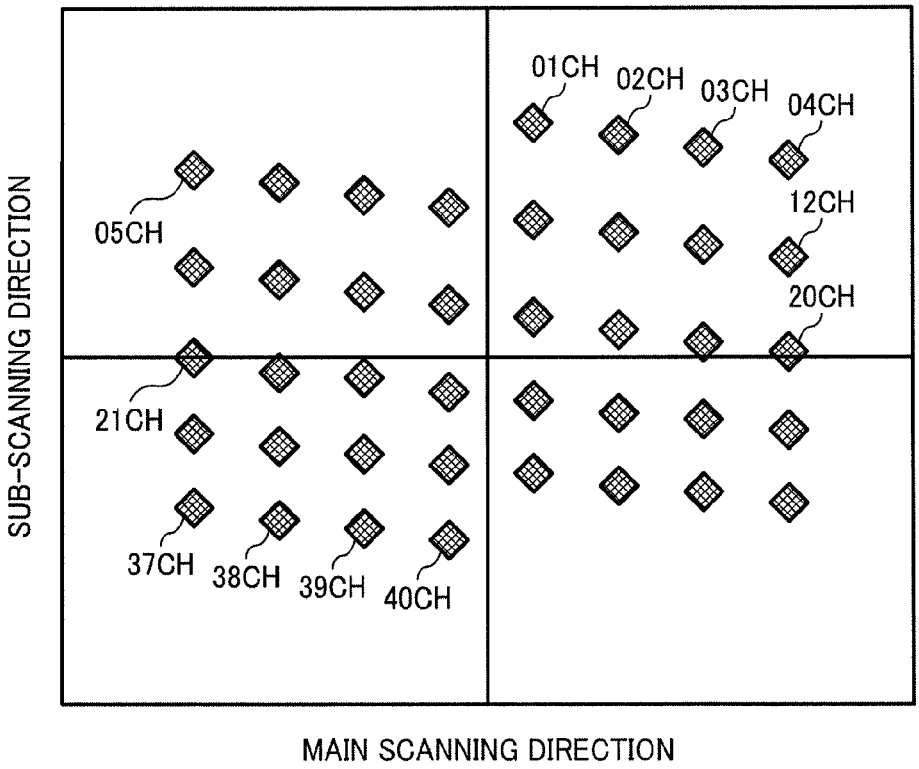
FIG. 3 schematically illustrates an exemplary arrangement of light emission points of a VCSEL according to one embodiment of the present invention.

Now, an exemplary arrangement of the light emission points of the VCSEL 51 is described with reference to FIG. 3. The VCSEL 51 includes light emission points of forty channels (CH) arranged on a two dimension as shown. A block of the light beams emitted from 40 channels on the VCSEL executes the scanning of the photoconductive drum 1 at once.

Thus, a scanning cycle becomes (40×D)/Vmax, while a block scanning length becomes 40×D, when the maximum process line speed of the laser printer 100 is represented by Vmax and a dot center interval between centers of dots (i.e., beam spots on the photoconductive member) in the sub scanning direction is represented by D.

This embodiment employs the skip scanning system to decrease influence of the reciprocal failure. Thus, to provide prescribed intervals in the sub scanning direction intervals and to avoid overlap of light beams, the value D is assigned to an interval between 20 and 21 CHs among forty light beams, while that of 2×D is assigned to each of the remaining intervals. Thus, the forty light beams are scanned at once being aligned in the sub-scanning direction on the image bearer (e.g. a photo-conductive drum 1) ate as shown in FIG. 4B.

Figure 4:
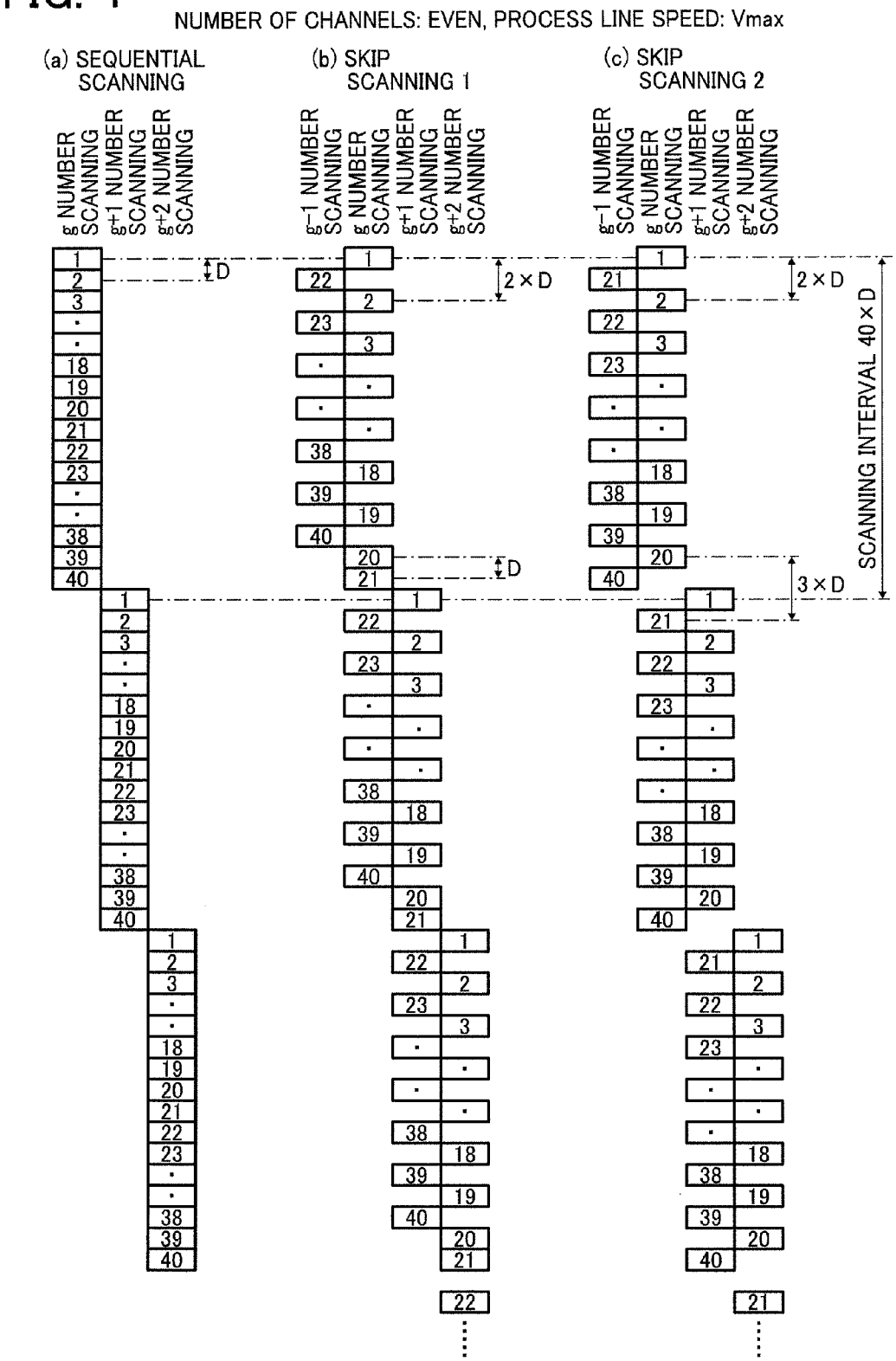

As shown in FIG. 4A, a comparative VCSEL has forty channels of light emission points all arranged at the same interval D and execute sequential scanning (different from skipping one) in a process line speed Vmax.

Thus, one scanning block having a length of 40×D in the sub-scanning direction is completely written at once for each of g, g+1, and g+2 order number scanning operations in turn.

Whereas in the skip scanning as shown in FIG. 4B, a twice size scanning block having a length (2×40×D=80×D) in the sub-scanning direction is written with every other lines being scanned in a skipping manner.

Specifically, as shown, the upper half scanning block (having the length of 40×D) is collectively written by g−1 (with 22 to 40 CHs) and g order scanning operations (with 1 to 21 CHs). Respective scanning blocks are sequentially written by repeating the g+1 and g+2 order scanning operations hereinafter.

Instead of the interval D, 3×D can be used for the interval between the 20 and 21 channels while remaining intervals are 2×D as shown in FIG. 4C.

As shown, skip scanning is also executed avoiding the overlap of dots (i.e., light beams) on the image bearer.

Specifically, the interval between the M/2 and (M/2+1) order number light beams (i.e., Channels) of the VCSEL 51 is selected from one of the D and 3×D, while those between the other order number channels being 2×D, when the number M is even and is more than four. As a result, the dots do not overlap with each other on the image bearer during the skip scanning.

Figure 5:
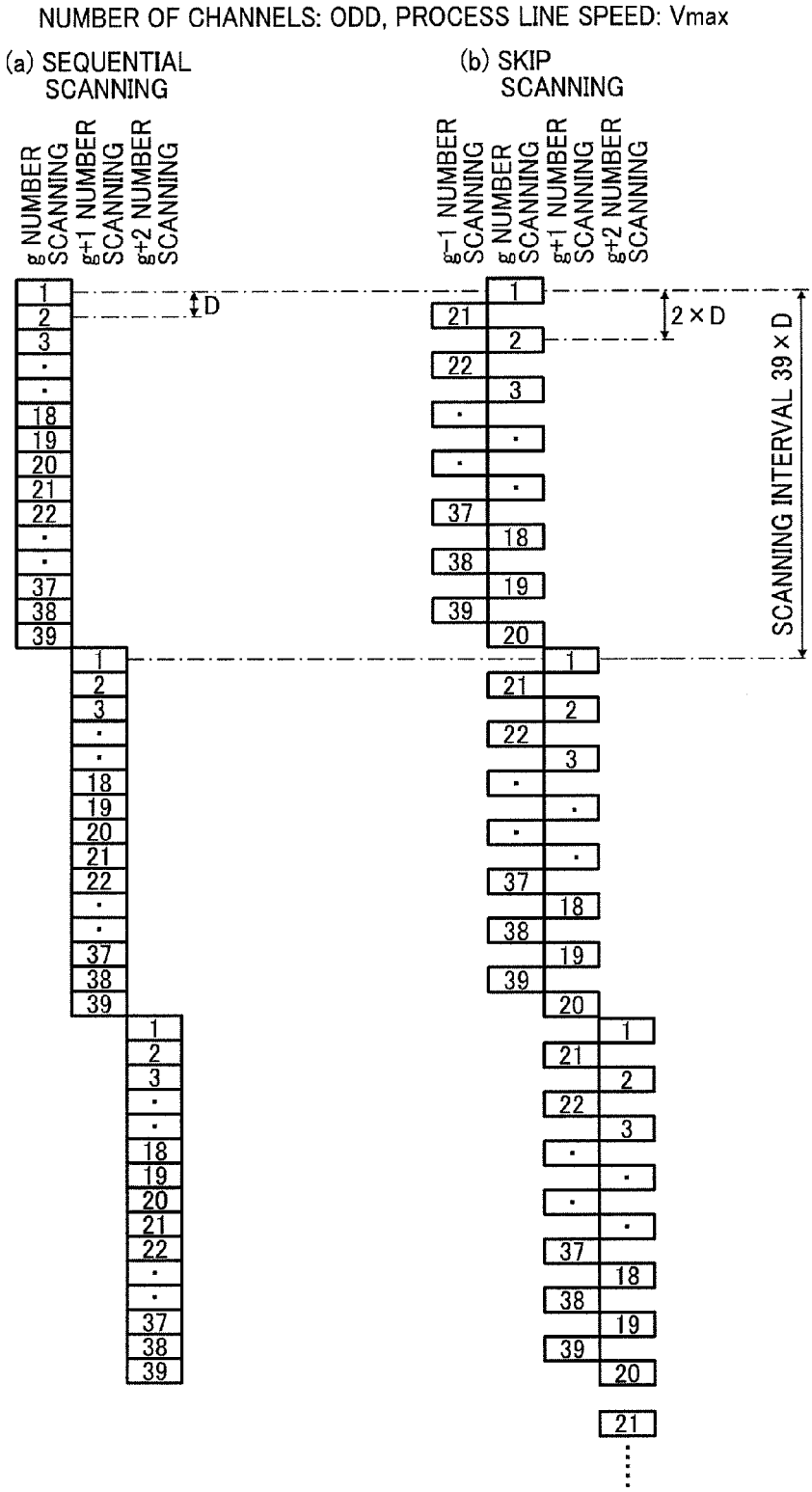

When the beam number (i.e. CH number) is odd and is more than three, the dots also do not overlap with each other during the skip scanning even if all of intervals of the channels is 2×D as shown in FIG. 5B. An exemplary sequential scanning is also illustrated for the comparison purpose in FIG. 5A.

Now, another embodiment of controlling a number of usage light beams is described. Since the light emission output power P of the light source necessary for the exposure energy Q is calculated by the formula 1 as mentioned earlier, the light emission output power P does not need to be changed as far as N×40 pieces of light beams execute scanning and meets the below described equality;

$$V=N\times \mathrm{Vmax}\ (N<1).$$

At same time, a scanning cycle (40×D)/Vmax is maintained as before, while a scanning length is N×40×D. Accordingly, even when a thick paper is used, for example, the process line speed can be changed from the maximum level without increasing a cost. The laser printer 100 generally assigns a normal line speed for conveying a plain paper as the maximum process line speed Vmax. Thus, when the line speed V varies, N becomes less than one (i.e., N<1).

An exemplary scanning operation when the line speed is changed is described with reference to FIGS. 6A to 6D, corresponding to FIGS. 4A to 4D, respectively. As shown, the process line speed is changed to 0.95 times of the Vmax.

When the line speed V times the Vmax by N (N<1), the same numbers of channels of (M−M×N)/2 from the both ends in the sub scanning direction of the channels are controlled not to turn on not to be used. However, the N is chosen so that "I" is a natural number and meets the below listed formula;

$$(M-M\times N)/2=i.$$

Specifically, when the formula is represented by N, the below listed equality is established;

$$N=(M-2i)/M.$$

For example, as shown in FIGS. 6A and 6C, when the line speed V is changed to 0.95 times of the Vmax, the same number of a beam calculated below and ranging from the both ends of the channels (CHs 1 to 40), totally two, are controlled not to turn on;

$$i=(40-40\times 0.95)/2=(40-38)/2=1.$$

The beam number to use becomes 38.

Figure 6:
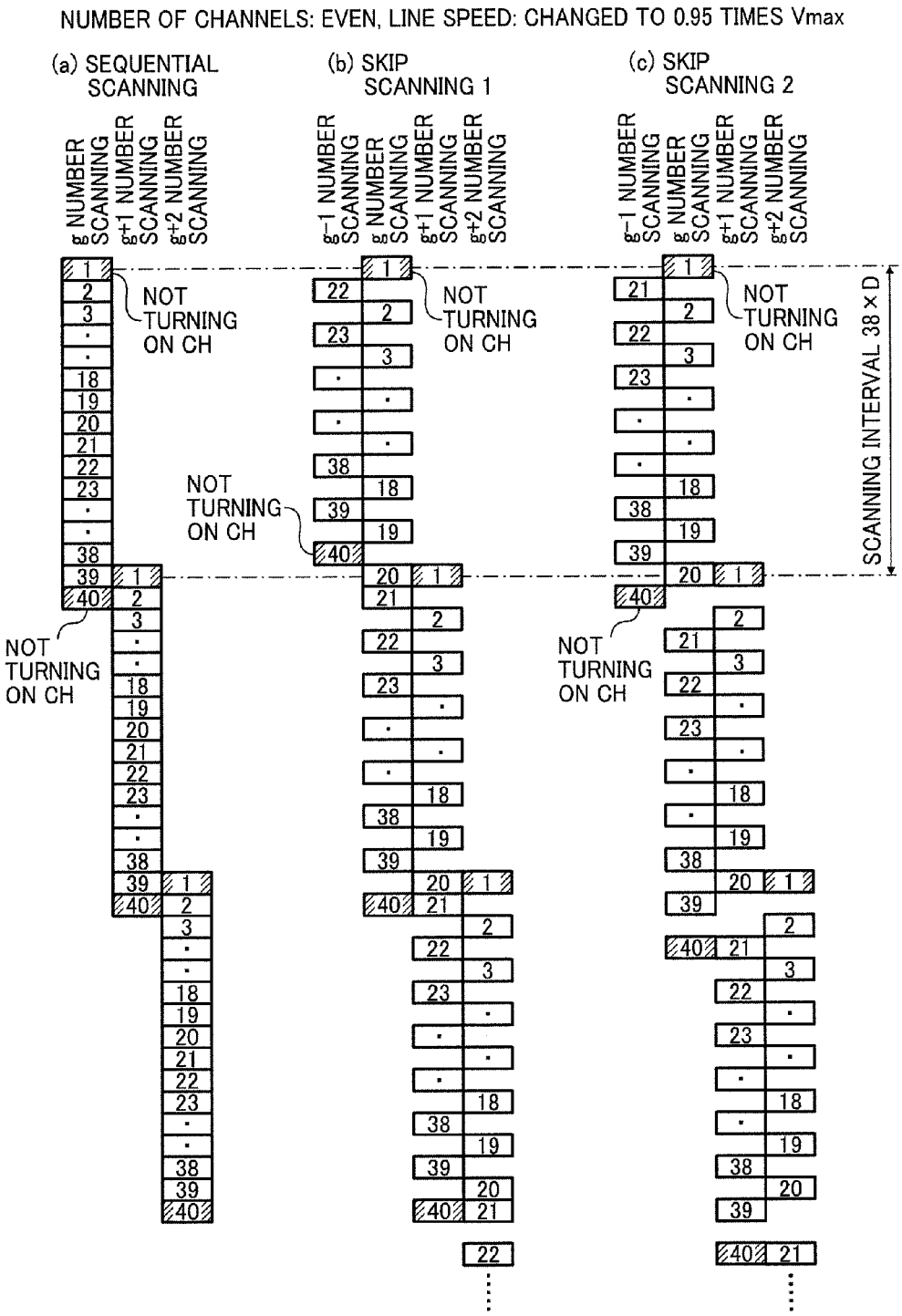

Thus, as shown in FIG. 6, skip scanning is executed avoiding the overlap of dots over the scan length of 38×D. Specifically, when N represents the formula, the below listed equality is established;

$$N=(40-2\times 1)/40=0.95.$$

Exemplary conditions when the N is changed are described hereinafter. When the line speed V is changed to 0.9 times of the Vmax, the same number of beams calculated below and ranging from the both ends of the channels, totally four beams, are controlled not to turn on, while the usage beam number is 36;

$$i=(40-40\times 0.9)/2=(40-36)/2=2.$$

Similarly, when the line speed V is changed to 0.8 times of the Vmax, the same number of beams calculated below ranging from the both ends of the channels, totally eight beams, are controlled not to turn on, while the usage beam number is 32;

$$i=(40-40\times 0.8)/2=(40-32)/2=4.$$

Further, when the line speed V is changed to 0.7 times of the Vmax, the same number of beams calculated below and ranging from the both ends of the channels, totally twelve beams, are controlled not to turn on, while the usage beam number is 28;

$$i=(40-40\times 0.7)/2=(40-28)/2=6.$$

Further, when the line speed V is changed to 0.6 times of the Vmax, the same number of beams calculated below and ranging from the both ends of the channels, totally sixteen beams, are controlled not to turn on, while the usage beam number is 24;

$$i=(40-40\times 0.7)/2=(40-28)/2=6.$$

Exemplary specific numeral values used when the line speed is changed in the laser printer 100 in this embodiment are described with reference to FIG. 10.

In the laser printer 100, the maximum value Vmax of the process line speed is 352.8 mm/s. As shown, a pattern "a" represents a condition V=Vmax. Patterns "b to e" represent conditions of line speeds when the Vmax is changed to 0.9, 0.8, 0.7, and 0.6 times thereof, with usage beam numbers of 40, 36, 32, 28, and 24, respectively. Respective scan intervals are shown in the table. Pixel density, a dot center interval, required exposure energy, a beam turn on time rate, a writing width, light usage efficiency, light emission output power from a light source, and a scan cycle are the same regardless of the respectively different patterns as shown. A control device, not shown, included in the laser printer 100 determines a number of beams of the VCSEL 51 when the line speed is changed.

Figure 7:
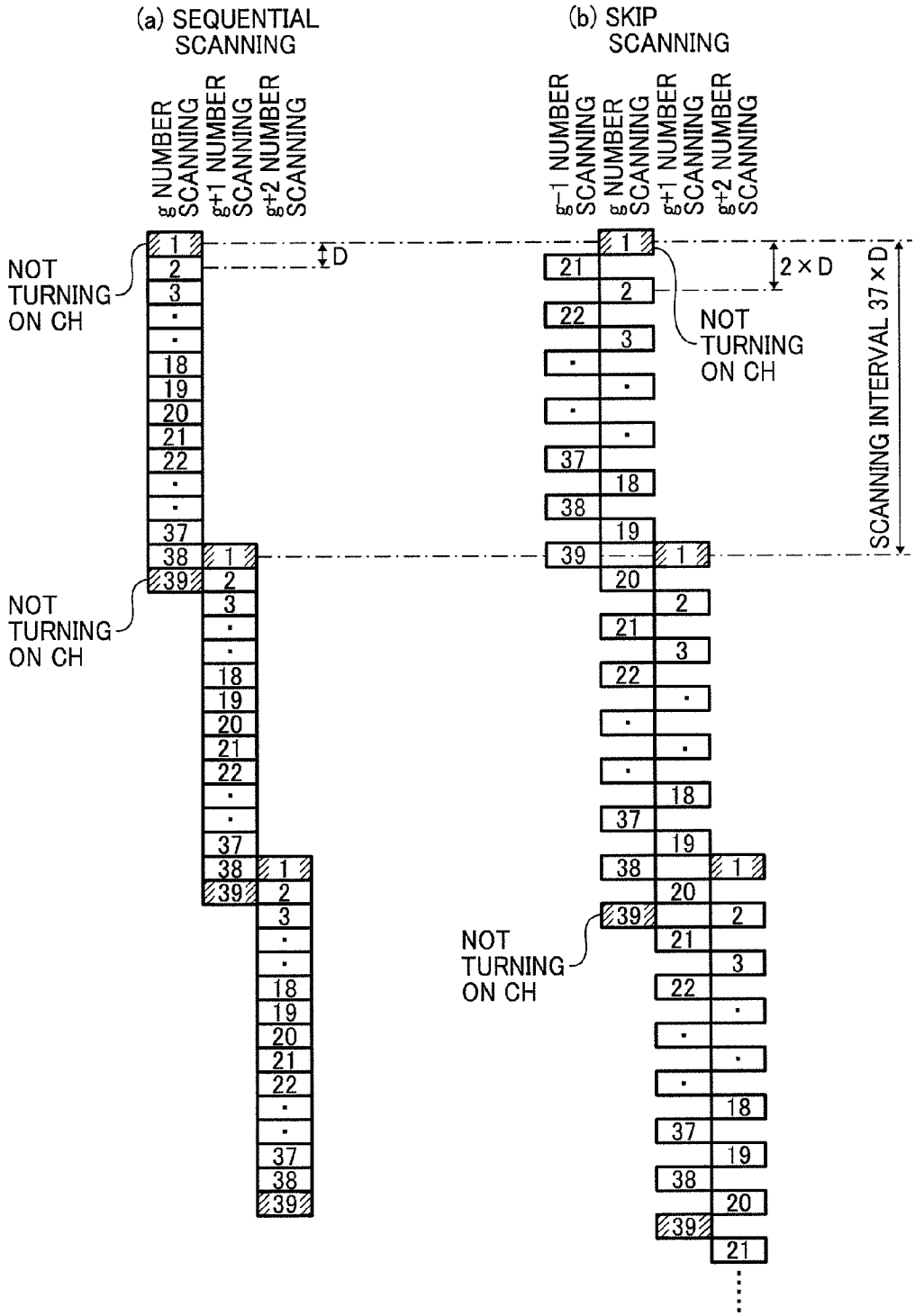

An exemplary scanning is executed as shown in FIG. 7 when the number of beams is more than three and the line speed is changed, and a process line speed is set to be 0.9487 times of the Vmax. As shown, FIGS. 7A and 7B correspond to FIGS. 5A and 5B of Vmax, respectively.

When the number of beams is odd, and "i" number beams arranged from the both side ends of channels, respectively, are controlled not to turn on, approximate to a natural number is used as the value N, because "i" is not dividable then.

Specifically, when the total number of beams is thirty nine, and two channels arranged at the both side ends, respectively, are to be controlled not to turn on thereby "i" is one (i=1), the value N=0.9487 is used as approximate, because the N is calculated as follows;

$$N=(M-2\times i)/M=(39-2\times 1)/39=37/39=0.9487179.$$

Further, when two units of two channels, totally four channels, arranged at the both side ends, respectively, are controlled not to turn on thereby the "i" becomes two (i=2), the N is calculated as follows:

$$N=(M-2\times i)/M=(39-2\times 2)/39=35/39\approx 0.8974.$$

Thus, when the VCSEL 51 having multiple channels of light emission points is used as a light source device, skip scanning can be executed avoiding overlap of dots on the image.

Thus, even when the process line speed is changed in multiple steps, a center of light emission power P of the light source required for exposure of an image bearer does not need to largely change. Further, a scan frequency changing range of an optical light deflector can be decreased.

When the process line speed is changed to N times (N<1), the number of usage channels of the VCSEL 51 is changed to N×M (M represents a total number of channels of VCSEL 51), so that the central value of the light emission power P of the light source required for the exposure of the image bearer, and the scan frequency of the optical light deflector can be maintained, even though the process line speed is changed in multi steps.

Figure 8:
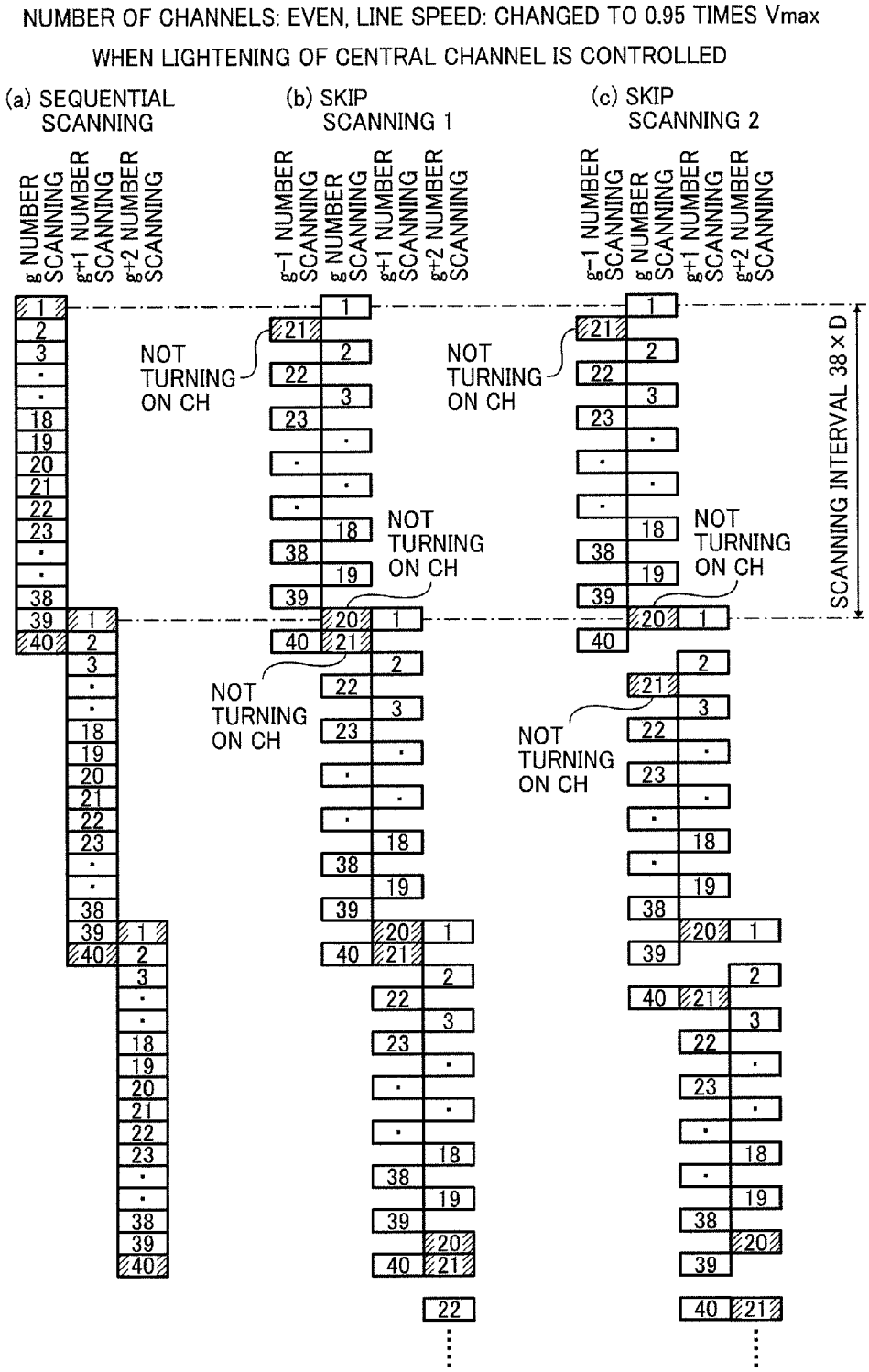

Now, a second embodiment is described with reference to FIGS. 8A to 8C, in which the same number of channels are symmetrically tuned off from the center of the channels different from the first embodiment.

Specifically, as described with reference to FIGS. 8B and 8C, the line speed is 0.95 times of the Vmax and a block scanning length in the sub-scanning direction is 38×D.

As shown, even though switching of the process line speed can be handled by controlling turning on of the central channels, an optical imaging performance possibly likely deteriorate in comparison with the above-mentioned turning off control from the both ends. Because, light beams passing through the neighboring parts of the imaging lens (first and second imaging lenses 54 and 55) are used.

In the sequential scanning, even though the above-mentioned central channel control is impossible, a different number of channels can be turned off in turn from an end of the channels. However, to use M pieces of light beams maintaining an optical performance stable, the channels of both side ends are preferably turned off as shown in FIG. 8A.

Now, the third embodiment is described, in which the first and second embodiments are substantially combined.

Specifically, a system in that the same number of channels are selectively and alternatively tuned off symmetrically from both side ends of the channel alignment or from the center thereof in accordance with a change of the process line speed. Specific their configurations and operations are substantially the same as above-mentioned first and second embodiments.

As a result, regardless of the process line speed, channels of light beams to be turned on are not fixed to a prescribed items, so that the VCSEL 51 that generally ends its life in accordance with a turn on term per channel can prolong the life.

Further, a light beam from a channel that always turns on can be used to detect a write start time different from that described with reference to FIG. 2. Thus, the same light beam can be used to both detect the write start time and form an image while simplifying control and suppressing positional displacement of the dots caused by beam (i.e., channel) arrangement error. Such a configuration can be employed in the above-mentioned every embodiment.

Figure 9:
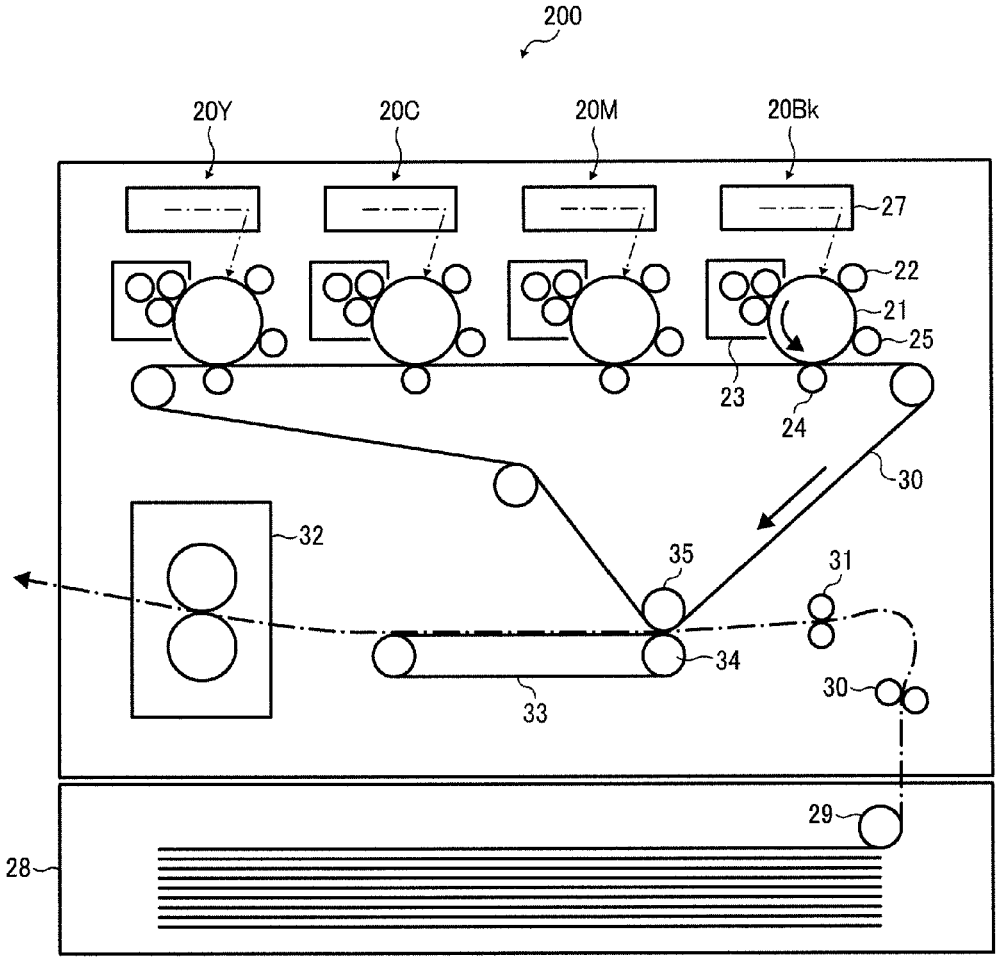
FIG. 9 schematically illustrates an exemplary color image forming apparatus according to one embodiment of the present invention.

Now, an exemplary modification employed in a full-color image forming apparatus is described with reference to FIG. 9. As shown, a full-color image forming apparatus 200 is a tandem type and includes an intermediate transfer belt 30 almost at its center, which is driven clockwise in the drawing while being wound around plural supporting rollers. Four image formation units 20Y to 20B*k* of four component colors, respectively, are arranged along the upper traveling side of the intermediate transfer belt 30.

The respective image formation units 20 equally include the same configuration of image bearers 21, etc., except for mono color of usage toner. Around each of the photoconductive drums 31, there are provided a charge device 22, a developing device 23, a cleaning device 25, and the like. Also provided inside the intermediate transfer belt 30 is a transfer roller 24 serving as a primary transfer device. Further, an optical writing device 27 is arranged above each of the photoconductive drums 21 that executes optical scanning by emitting a laser light onto the photoconductive drums 1. The configuration of each of the optical writing devices 27 is almost the same as described with reference to FIG. 2.

Below the intermediate transfer belt 30, there is provided a transfer conveyance belt 33 and a transfer roller 34 serving as a secondary transfer device pressure contacting an opposing roller 35. Beside the transfer conveyance belt 33, a fixing device 32 is arranged.

A sheet-feeding tray is arranged at a lower section in the apparatus body as a sheet feeding section 28 to accommodate plural sheets. The sheet feeding section 28 includes a sheet-feeding device 29 that launches the sheets stacked on the sheet-feeding tray one by one. The sheet launched from the sheet feeding section 28 is fed toward a registration roller 31 via a conveyance roller pair 30.

Now, an exemplary image formation operation of the color printer 200 is briefly described. The photoconductive drums 21 in the image formation units 20 are driven rotated by drive devices, not shown, clockwise in the draw, and are charged in prescribed polarities on their surfaces by the charge devices 22, respectively. The respective surfaces receive laser lights emitted from the optical writing devices 27, and carry latent images thereon. At that moment, mono color image information elements are used to expose the respective photoconductive drums 21 by decomposing prescribed full-color image into respective mono color information of Yellow, Magenta, Cyan, and Black. The thus formed latent images are provided with respective color toner by the developing devices 23 and become toner images to be visualized.

Further, the intermediate transfer belt 30 is driven clockwise in the drawing, so that the respective mono color toner images are superimposed one by one from the photoconductive drums 21 onto the intermediate transfer belt 30 by the function of the primary transfer rollers 24. Thus, a full-color toner image is carried on the surface of the intermediate transfer belt 30.

A monochrome image can be created only by using one of the image formation units 20, for example, the right most Bk unit when the black image is formed. Otherwise, either a dual or triple mono color image can be created by selectively using two or more of the image formation units 20.

Further, the cleaning device 25 removes the toner remaining on the surface of the photoconductive drum 21 having transferred the toner image therefrom. Then, the surface is subjected to the charge remover, so that a surface potential is initialized and becomes ready to the next image formation. Further, the sheet is fed from the sheet feeding section 28, and is further launched toward the secondary transfer position by the registration roller pair 31 in synchronism with the toner image on the intermediate transfer belt 30. In this example, a transfer voltage having a polarity opposite to that of a charge of toner of the toner image on the intermediate transfer belt 30 is provided to the secondary transfer roller 34, so that the toner image is transferred at once from the intermediate transfer belt to the sheet. The toner image on the sheet is fused into the sheet when passing through the fixing device 32 due to heat and pressure. The sheet having fixed toner image thereon is ejected onto a sheet ejection tray, not shown, arranged on the side surface of the apparatus body by a sheet ejection roller.

Also in the color printer 200 of this modification, the process line speed is similarly changed and decreased from the maximum as mentioned heretofore when a thick paper is used. In such a situation, the number of beams of the VCSEL 51 on the optical writing device 27 is changed to execute skip scanning while avoiding overlap of dots of light beams.

Different from the example described with reference to FIG. 9, an optical writing device can be commonly used by the respective image formation units. Also in such a situation, the number of beams of the VCSEL 51 is changed to execute skip scanning without overlapping dots of light beams.

The above-mentioned number of beams and arrangement of the VCSEL 51 can be appropriately designated. Further, the maximum process line speed and magnification in relation thereto can be appropriately changed to the other levels. The above-mentioned pixel density, the dot-center interval, the required exposure energy, and the beam turn on time rate can also be appropriately changed to the other values. Also appropriately changed to the other values are the writing width, the light usage efficiency, the light emission output power from a light source, and the scan cycle.

The above-mentioned configuration of the image forming apparatus can be optionally changed, for example, an order of arrangement of the image formation units of the tandem type to the other. Specifically, plural devices can be arranged around one photoconductive member and a revolver type-developing device can be employed.

ADVANTAGE

According to one embodiment of the present invention, when a VCSEL having multiple channels is used as a light source device, and a number of turn off light beams is decreased from the maximum value, since the same number of those are turn off from both ends, skip scanning can be executed without overlapping dots of light beams.

Numerous additional modifications and variations of the present invention are possible in light of the above teachings. It is therefore to be understood that within the scope of the appended claims, the present invent ion may be practiced otherwise that as specifically described herein.

What is claimed is:

1. An optical writing apparatus, comprising;

a light source device including a VCSEL having an alignment of at least two channels in a sub scanning direction configured to emit at least two light beams in a block;

a deflector configured to deflect the at least two light beams toward an image bearer, said image bearer forming an image by changing a line speed of image formation;

a control device configured to decrease a number of light beams by turning off a prescribed same number of the channels symmetrically from the both ends of the alignment in accordance with the line speed.

2. The optical writing apparatus of claim 1, wherein the control device is further configured to decrease the number of light beams by alternately turning off a prescribed same number of the channels symmetrically from either the both ends and the center of the alignment in accordance with the line speed.

3. The optical writing apparatus as claimed in claim 1, wherein said light beams are written by a skip scanning manner.

4. The optical writing apparatus as claimed in claim 1, wherein said number of channels emitting the light beams is even more than four, and wherein an interval in the sub-scanning direction between central two channels among the at least four is D, and wherein each of intervals between the other channels being 2D.

5. The optical writing apparatus as claimed in claim 1, wherein said number of channels emitting the light beams is even more than four, and wherein an interval in the sub-scanning direction between central two channels among the at least four is D, and wherein each of intervals between the other channels being 2D/3D.

6. The optical writing apparatus as claimed in claim 1, wherein said number of channels emitting the light beams is odd more than three, and wherein an interval in the sub-scanning direction between each of channels is the same.

7. The optical writing apparatus as claimed in claim 1, further comprising a detection device configured to detect a write start time based on a light beam not turned off when the number of channels emitting the light beams is decreased.

8. An image forming apparatus including an optical writing device as claimed in claim 7, further comprising a speed controller configured to change a process line speed, and wherein the number of channels emitting the light beams is changed in accordance with the process line speed.

9. The image forming apparatus as claimed in claim 8, wherein said process line speed is decreased when a relatively thick paper or a particular paper is used.

* * * * *